US009719193B2

(12) United States Patent
Xie et al.

(10) Patent No.: US 9,719,193 B2
(45) Date of Patent: Aug. 1, 2017

(54) METHOD FOR DRAFTING SPUN YARNS IN THREE STAGES

(71) Applicant: JIANGNAN UNIVERSITY, Jiangsu (CN)

(72) Inventors: Chunping Xie, Jiangsu (CN); Weidong Gao, Jiangsu (CN); Xinjin Liu, Jiangsu (CN); Xuzhong Su, Jiangsu (CN); Bojun Xu, Jiangsu (CN); Hong Zhang, Jiangsu (CN)

(73) Assignee: JIANGNAN UNIVERSITY, Wuxi, Jiangsu (CN)

( * ) Notice: Subject to any disclaimer, the term of this patent is extended or adjusted under 35 U.S.C. 154(b) by 298 days.

(21) Appl. No.: 14/622,994

(22) Filed: Feb. 16, 2015

(65) Prior Publication Data

US 2015/0252497 A1 Sep. 10, 2015

(30) Foreign Application Priority Data

Mar. 6, 2014 (CN) ..... 2014 1 0081503

(51) Int. Cl.
*D01H 5/26* (2006.01)
*D01H 13/14* (2006.01)

(52) U.S. Cl.
CPC ..... *D01H 5/26* (2013.01); *D01H 13/14* (2013.01)

(58) Field of Classification Search
CPC .. D01H 5/22; D01H 5/26; D01H 5/32; D01H 5/38
See application file for complete search history.

(56) References Cited

U.S. PATENT DOCUMENTS 2,679,072 A * 5/1954 New ..... D01H 5/22 19/242
2,813,309 A * 11/1957 West ..... D01H 5/22 19/0.26
3,031,724 A * 5/1962 Butler ..... D01H 5/26 19/250
3,105,998 A * 10/1963 Raboisson ..... D01H 5/74 19/244
3,402,434 A * 9/1968 Hiroshi ..... D01H 5/22 19/272
4,114,358 A * 9/1978 Tsuchida ..... D01H 1/115 57/293
4,644,609 A * 2/1987 Lattner ..... D01H 13/185 19/244

(Continued)

FOREIGN PATENT DOCUMENTS

CN 2495663 Y 6/2002
CN 2623707 Y 7/2004

(Continued)

*Primary Examiner* — Shaun R Hurley
(74) *Attorney, Agent, or Firm* — Ladas & Parry LLP; Margaret Anderson

(57) ABSTRACT

The present invention relates to a method for drafting spun yarns in three stages. The method comprises drafting fiber strips to obtain fiber strands in the first-stage draft zone, drafting fiber strands to obtain non-discrete fiber bands without twist distribution in the second-stage draft zone, and drafting fiber bands to obtain twist less fiber assemblies in the third-stage draft zone. The methods optimize the maximum total draft ratio to obtain twist less fiber assemblies while maintaining evenness and required quality of resultant yarns.

11 Claims, 2 Drawing Sheets

(56) References Cited

U.S. PATENT DOCUMENTS

| | | | | | |
|---|---|---|---|---|---|
| 4,712,365 | A * | 12/1987 | Ferrer | D01H 5/26 | 57/12 |
| 4,845,813 | A * | 7/1989 | Salaun, Jr. | D01H 5/22 | 19/258 |
| 4,953,349 | A * | 9/1990 | Fehrer | D01H 1/025 | 19/236 |
| 4,974,296 | A * | 12/1990 | Vidler | D01H 5/38 | 19/239 |
| 5,600,872 | A * | 2/1997 | Artzt | D01H 1/025 | 19/150 |
| 6,250,060 | B1 * | 6/2001 | Scheerer | D01H 1/115 | 19/236 |
| 6,263,655 | B1 * | 7/2001 | Artzt | D01H 5/26 | 19/150 |
| 6,332,244 | B1 * | 12/2001 | Camozzi | D01H 1/22 | 19/150 |
| 2001/0005923 | A1 * | 7/2001 | Hartung | D01H 1/22 | 19/236 |
| 2001/0018823 | A1 * | 9/2001 | Dinkelmann | D01H 5/26 | 57/315 |
| 2001/0054280 | A1 * | 12/2001 | Camozzi | D01H 5/26 | 57/315 |
| 2002/0152587 | A1 * | 10/2002 | Breuer | D01H 1/22 | 19/236 |
| 2003/0114951 | A1 * | 6/2003 | Breuer | D01H 1/22 | 700/142 |
| 2006/0191109 | A1 * | 8/2006 | Hosel | D01G 31/006 | 19/236 |
| 2013/0239721 | A1 * | 9/2013 | Schneider | D01H 5/72 | 74/412 R |

FOREIGN PATENT DOCUMENTS

| | | | |
|---|---|---|---|
| CN | 100545331 | C | 9/2008 |
| CN | 100425749 | C | 10/2008 |
| CN | 1056205 | C | 9/2009 |
| CN | 103469382 | A | 12/2013 |
| EP | 1739214 | A3 | 4/2009 |

* cited by examiner

METHOD FOR DRAFTING SPUN YARNS IN THREE STAGES

FIELD OF THE INVENTION

The present invention relates to a spinning method, and in particular a method for drafting spun yarns in three stages. The present invention belongs to the technical field of ring spinning.

BACKGROUND OF THE INVENTION

To the knowledge of the applicant, the drafting system is an important part of a spinning machine and its performance directly affects the quality of resultant yarns of the spinning machine. The drafting systems of existing spinning machines are mostly three-roller drafting mechanisms, and the typical three-roller drafting mechanisms include the ordinary three-roller-double-apron structure and the three-roller-four-apron structure which can achieve a draft ratio of 80 to 100.

The ordinary three-roller-double-apron structure is divided into a front draft zone and a rear draft zone. Since only simple roller drafting is used in the rear draft zone, the middle friction field is weak and the draft ratio is generally less than 1.4. It is difficult for such a structure to improve the total draft ratio of spinning machines. The total draft ratio of such a structure is small and is in the range of 20 to 50.

To solve the problem about the low draft ratio in the rear draft zone of the above-mentioned structure, the Chinese invention patent (patent number 961.07383.7 and authorized publication number CN1056205C) and the Chinese utility model patent (patent number 01243901.0 and patent publication number CN2495663Y) respectively disclose a three-roller-three-apron drafting mechanism and a three-roller-four-apron drafting mechanism. These drafting mechanisms can overcome the defect about a low drafting ratio in the rear draft zone of a three-roller drafting mechanism and can increase the maximum total draft ratio to 100 and 150, respectively.

The above-mentioned drafting mechanisms all adopt a three-roller-double-draft-zone structure, wherein the front draft zone is the main draft zone and bears the major drafting responsibility; the rear draft zone prepares for the front draft zone, pre-drafts and combs fed strands. Since fed roving strands have a certain twist, the rear draft zone needs to untwist fed strands so that they are more orderly before going to the front draft zone and they can be fully drafted in the front draft zone. On the basis of this, the draft ratio in the rear draft zone is heavily restricted. As a result, the maximum total draft ratio of the whole draft mechanism is restricted and a further breakthrough cannot be made.

To solve the problem, the Chinese utility model (patent number 03217782.8 and authorized publication number CN2623707Y) discloses a four-roller-four-apron drafting mechanism for a spinning machine. Such a drafting mechanism has a front draft zone, a middle draft zone, and a rear draft zone, and the maximum total draft ratio is up to 200. To further improve the mechanism, the Chinese invention patent (patent number 200710143612.6 and authorized publication number CN100545331C) discloses a four-roller drafting device for a ring spinning machine. The four-roller drafting device effectively solves the problem about hairiness during twisting of yarns. However, the four-roller drafting technique in the two representative patents is formed by simply adding one line of rollers on the basis of the existing three-roller drafting technique. No breakthrough has been made in its drafting principle. The maximum total draft ratio is already bottlenecked and cannot further be broken through. In addition, the four-roller structure already reaches the limit of the number of lines of rollers. So far, a drafting mechanism with at least five lines of rollers has never been put into practice successfully. Therefore, a drafting technique which can break through the existing drafting principle and can further increase the maximum total draft ratio urgently needs to be developed.

SUMMARY OF THE INVENTION

To overcome the technical problems in the prior art, the present invention is intended to provide a method for drafting spun yarns in three stages, which can significantly increase the maximum total draft ratio.

To solve the technical problems, the following technical solution is adopted for the present invention:

A method for drafting spun yarns in three stages, which is characterized in that the drafting mechanism has an entrance and an exit, four lines of rollers are arranged in turn from the entrance to the exit to form the first-stage, second-stage, and third-stage draft zones, and each draft zone is respectively located between the adjacent two lines of rollers;

said method comprises the following steps:

step 1. a fiber strip whose twist and weight are detected in advance is fed from the entrance of the drafting mechanism, said fiber strip is drafted in the first-stage draft zone to obtain a fiber strand; the twist of said fiber strand is 75% to 95% of that of the fiber strip and the weight of said fiber strand is 71% to 99% of that of said fiber strip; the draft ratio in said first-stage draft zone is 1.01 to 1.40;

step 2. said fiber strand is drafted in the second-stage draft zone to obtain a non-discrete fiber band without twist redistribution; the twist of said fiber band is 15% to 60% of that of the fiber strip, and the weight of said fiber band is 47% to 98% of that of the fiber strip; the draft ratio in said second-stage draft zone is 1.01 to 1.52;

step 3. said fiber band is drafted in the third-stage draft zone to obtain a twist less fiber assembly; the weight of said fiber assembly is 0.3% to 9.8% of that of the fiber strip; the draft ratio in said third-stage draft zone is 10 to 150; the obtained fiber assembly is output from the exit of the drafting mechanism and is twisted into spun yarns.

The improved technical solution of the present invention is as follows:

Preferably, the twist and weight of the obtained fiber strand, fiber band, or fiber assembly are respectively detected by a detector in the first-stage, second-stage, and third-stage draft zones of said drafting mechanism; the driving of each line of rollers is controlled by a separate servo motor; the revolutions of each line of rollers are respectively adjusted by the separate servo motor according to the detection signal received by the controller from the detector and the corresponding preset value or scope of preset value of each draft zone so that the twist and fiber weight of the obtained fiber strand, fiber band, or fiber assembly can fall within the scope required for each draft zone.

Preferably, the four lines of rollers of said drafting mechanism are the rear drafting roller pair, the middle-rear drafting roller pair, the middle-front drafting roller pair, and the front drafting roller pair, respectively; the first-stage, second-stage, and third-stage draft zones are respectively formed between said rear drafting roller pair and middle-rear drafting roller pair, between said middle-rear drafting roller pair and middle-front drafting roller pair, and between said middle-front drafting roller pair and front drafting roller pair.

Preferably, in step 1, the detector in the first-stage draft zone sends a detection signal containing the twist and fiber weight of the obtained fiber strand to the controller; the controller compares the detection signal with the preset value or scope of preset value of the first-stage draft zone and adjusts the revolutions of the rear drafting roller pair and the middle-rear drafting roller pair through the corresponding servo motors according to the comparison result so that the twist of the obtained fiber strand is 75% to 95% of that of the fiber strip and the weight is 71% to 99% of that of the fiber strip.

Preferably, in step 2, the detector in the second-stage draft zone sends a detection signal containing the twist and fiber weight of the obtained fiber band to the controller; the controller compares the detection signal with the preset value or scope of preset value of the second-stage draft zone and adjusts the revolutions of the middle-front drafting roller pair according to the comparison result and the revolutions of the middle-rear drafting roller pair so that the twist of the obtained fiber band is 15% to 60% of that of the fiber strip and the weight is 47% to 98% of that of the fiber strip.

Preferably, in step 3, the detector in the third-stage draft zone sends a detection signal containing the twist and fiber weight of the obtained fiber assembly to the controller; the controller compares the detection signal with the preset value or scope of preset value of the third-stage draft zone and adjusts the revolutions of the front drafting roller pair according to the comparison result and the revolutions of the middle-front drafting roller pair so that the obtained fiber assembly is twist less and the fiber weight is 0.3% to 9.8% of that of the fiber strip.

Preferably, said rear drafting roller pair consists of a rear upper roller and a rear lower roller, said middle-rear drafting roller pair consists of a middle-rear upper roller with a middle-rear upper apron and a middle-rear lower roller with a middle-rear lower apron, said middle-front drafting roller pair consists a middle-front upper roller with a middle-front upper apron and a middle-front lower roller with a middle-front lower apron, and said front draft roller pair consists of a front upper roller and a front lower roller.

Preferably, said rear lower roller, middle-rear lower roller, middle-front lower roller, and front lower roller are respectively driven by corresponding servo motors to rotate; said rear upper roller, middle-rear upper roller, middle-front upper roller, and front upper roller are driven by the corresponding rollers to rotate.

Preferably, said middle-rear upper apron and middle-rear lower apron, and said middle-front upper apron and middle-front lower apron respectively touch each other closely and rotate reversely to frictionally untwist and draft fiber strands to obtain non-discrete fiber bands without twist redistribution.

Preferably, a downward-pressing bar is equipped in the third-stage draft zone of said drafting mechanism, said downward-pressing bar touches fiber assemblies, and the detector in the third-stage draft zone of said drafting mechanism is a trace detector.

An in-depth, practical study made by the applicant shows that in the above-mentioned method of the present invention, a fiber strip fed in the drafting mechanism is first preliminarily drafted and untwisted in the first-stage draft zone, and is further drafted and reshaped in the second-stage draft zone to obtain a non-discrete fiber band without twist redistribution so that combing before the dominant draft is the most optimal, and then the dominant draft and extraction in the third-stage draft zone are brought into full play so that the maximum total draft ratio of the drafting mechanism can be up to 320; the main purpose of realizing the predetermined twist and fiber weight and the minor purpose of realizing the predetermined draft ratio in the first-stage, second-stage, and third-stage draft zones can ensure that the above-mentioned purposes can be realized in the draft zones and the whole draft mechanism can realize a super large draft ratio.

The present invention can produce twist less fiber assemblies with good evenness, help improve the quality of resultant yarns, especially, the yarn evenness, and make it possible that super high count yarns are produced when general quantitative fibers are fed in and general count yarns are produced when heavy quantitative fibers are fed in.

DETAILED DESCRIPTION OF THE INVENTION

The following further describes the invention in combination with the drawings and an embodiment. The present is not limited to the given embodiment.

Embodiment

Figure 1:
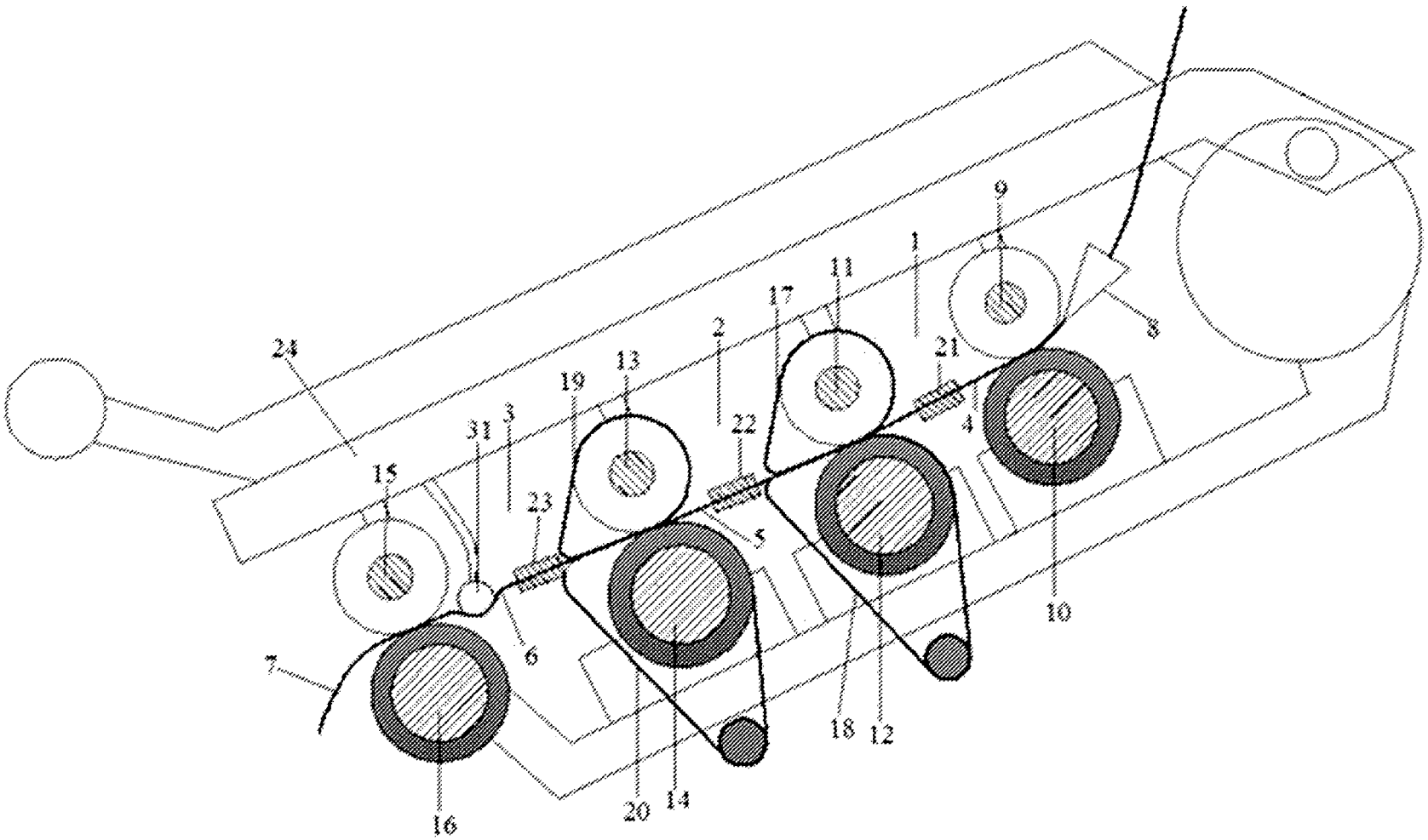
FIG. 1 shows the structure of the drafting mechanism of one embodiment of the present invention.
Figure 2:
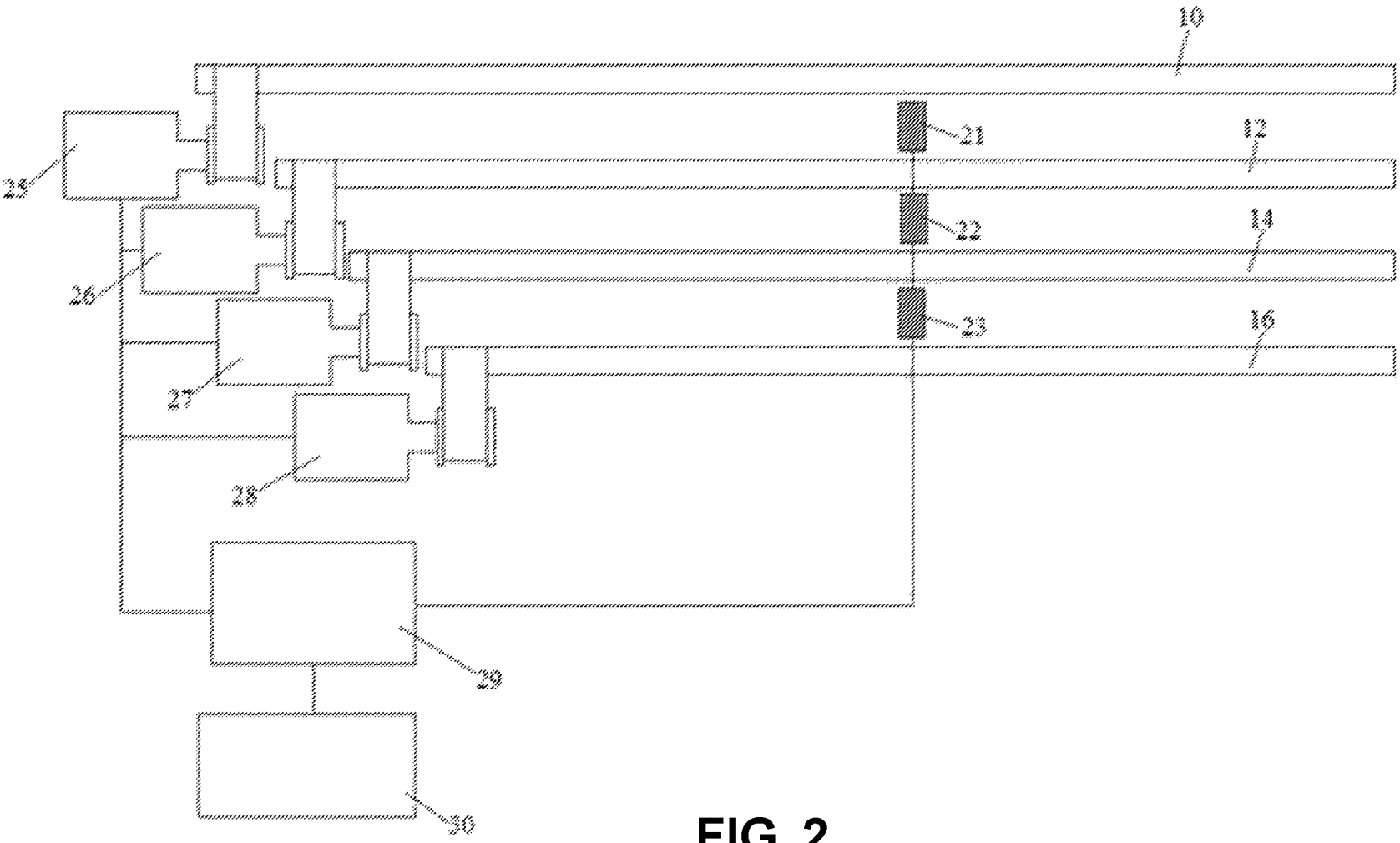
FIG. 2 shows the control system of the embodiment in FIG. 1.

As shown in FIG. 1 and FIG. 2, the drafting mechanism in the embodiment has an entrance and an exit, four lines of rollers are arranged in turn from the entrance to the exit to form the first-stage, second-stage, and third-stage draft zones, and each draft zone is respectively located between the adjacent two lines of rollers.

To be specific, the four lines of rollers of said drafting mechanism are the rear drafting roller pair, the middle-rear drafting roller pair, the middle-front drafting roller pair, and the front drafting roller pair, respectively; the first-stage draft zone (1), second-stage draft zone (2), and third-stage draft zone (3) are respectively formed between said rear drafting roller pair and middle-rear drafting roller pair, between said middle-rear drafting roller pair and middle-front drafting roller pair, and between said middle-front drafting roller pair and front drafting roller pair.

Said rear drafting roller pair consists of a rear upper roller (9) and a rear lower roller (10), said middle-rear drafting roller pair consists of a middle-rear upper roller (11) with a middle-rear upper apron (17) and a middle-rear lower roller (12) with a middle-rear lower apron (18), said middle-front drafting roller pair consists a middle-front upper roller (13) with a middle-front upper apron (19) and a middle-front lower roller (14) with a middle-front lower apron (20), and said front draft roller pair consists of a front upper roller (15) and a front lower roller (16).

Said rear lower roller (10), middle-rear lower roller (12), middle-front lower roller (14), and front lower roller (16) are respectively driven by corresponding servo motors (25, 26, 27, and 28) to rotate; said rear upper roller (9), middle-rear upper roller (11), middle-front upper roller (13), and front upper roller (15) are driven by the corresponding rollers to rotate.

Detectors (21, 22, and 23) are respectively equipped in the first-stage draft zone (1), second-stage draft zone (2), and third-stage draft zone. The signal output ends of the detectors (21, 22, and 23) are respectively connected to the input end of a programmable logic controller (PLC) (29), and the control ends of the servo motors (25, 26, 27, and 28) are respectively connected to the controlling end of the PLC (29). The PLC (29) is equipped with a touch screen (30). A downward-pressing bar (31) is additionally equipped in the third-stage draft zone (3).

In addition, the drafting mechanism has a cradle (24), and a fiber strip feeding device (8) at the entrance.

It should be noted that the detectors (21, 22, and 23) are all products of the prior art in the market. They may be a detector which can simultaneously detect the twist and fiber weight of the target object, or be the combination of a twist detector and a fiber weight detector.

The method for drafting spun yarns in three stages in the embodiment comprises the following steps:

Step 1. A fiber strip (32) whose twist and weight are detected in advance is fed from the entrance of the drafting mechanism, the fiber strip (32) is drafted in the first-stage draft zone (1) to obtain a fiber strand (4); the twist of the fiber strand (4) is 75% to 95% of that of the fiber strip (32) and the weight of the fiber strand (4) is 71% to 99% of that of the fiber strip (32); the draft ratio in the first-stage draft zone (1) is 1.01 to 1.40.

In step 1, the detector (21) in the first-stage draft zone (1) sends a detection signal containing the twist and fiber weight of the obtained fiber strand (4) to the controller (29); the controller (29) compares the detection signal with the preset value or scope of preset value of the first-stage draft zone (1) and adjusts the revolutions of the rear drafting roller pair and the middle-rear drafting roller pair through the corresponding servo motors (25 and 26) according to the comparison result so that the twist and weight of the obtained fiber strand (4) meet the above-mentioned requirements.

Step 2. The fiber strand (4) is drafted in the second-stage draft zone (2) to obtain a non-discrete fiber band (5) without twist redistribution; the twist of the fiber band (5) is 15% to 60% of that of the fiber strip (32), and the weight of the fiber band (5) is 47% to 98% of that of the fiber strip (32); the draft ratio in the second-stage draft zone (2) is 1.01 to 1.52.

In step 2, the detector (22) in the second-stage draft zone (2) sends a detection signal containing the twist and fiber weight of the obtained fiber band (5) to the controller (29); the controller (29) compares the detection signal with the preset value or scope of preset value of the second-stage draft zone (2) and adjusts the revolutions of the middle-front drafting roller pair according to the comparison result and the revolutions of the middle-rear drafting roller pair so that the twist and weight of the obtained fiber band (5) meet the above-mentioned requirements.

In addition, the middle-rear upper apron (17) and middle-rear lower apron (18), and the middle-front upper apron (19) and middle-front lower apron (20) respectively touch each other closely and rotate reversely to frictionally untwist and draft the fiber strand (4) to obtain a non-discrete fiber band (5) without twist redistribution.

Step 3. The fiber band (5) is drafted in the third-stage draft zone (3) to obtain a twist less fiber assembly (6); the weight of the fiber assembly (6) is 0.3% to 9.8% of that of the fiber strip (32); the draft ratio in the third-stage draft zone (3) is 10 to 150; the obtained fiber assembly (6) is output as a prepared fiber body (7) from the exit of the drafting mechanism and is then twisted into spun yarns.

In step 3, the detector (23) in the third-stage draft zone (3) sends a detection signal containing the twist and fiber weight of the obtained fiber assembly (6) to the controller (29); the controller (29) compares the detection signal with the preset value or scope of preset value of the third-stage draft zone (3) and adjusts the revolutions of the front drafting roller pair according to the comparison result and the revolutions of the middle-front drafting roller pair so that the obtained fiber assembly (6) is twist less and its fiber weight meets the above-mentioned requirement.

In addition, the downward-pressing bar (31) touches the fiber assembly (6) to press the fiber assembly (6) down slightly. The detector (23) in the third-stage draft zone (3) can be a trace detector so that it can better detect the fiber weight.

In the above-mentioned method, the controller (29) can adjust the revolutions of all lines of rollers as a whole so that the change of the revolutions of the roller is accurate, timely, and consistent.

Besides the above-mentioned embodiment, the present invention has other embodiments. All technical solutions formed by adopting equivalent replacement or transformation should fall within the scope of the claims of the present invention.

The invention claimed is:

1. A method for drafting spun yarns in three stages using a drafting mechanism that has an entrance and an exit, four lines of rollers arranged in turn from the entrance to the exit to form a first-stage draft zone, a second-stage draft zone, and a third-stage draft zone, and each draft zone is respectively located between adjacent two lines of rollers;

said method comprising:

feeding a fiber strip whose twist and weight are detected in advance from the entrance of the drafting mechanism;

drafting said fiber strip in the first-stage draft zone to obtain a fiber strand wherein a the twist of said fiber strand is 75% to 95% of that of the fiber strip and the weight of said fiber strand is 71% to 99% of that of said fiber strip and a first-stage draft ratio in said first-stage draft zone is 1.01 to 1.40;

drafting said fiber strand in the second-stage draft zone to obtain a non-discrete fiber band without twist redistribution, wherein the twist of said fiber band is 15% to 60% of that of the fiber strip, and the weight of said fiber band is 47% to 98% of that of the fiber strip and a second-stage draft ratio in said second-stage draft zone is 1.01 to 1.52;

drafting said fiber band in the third-stage draft zone to obtain a twist less fiber assembly wherein the weight of said fiber assembly is 0.3% to 9.8% of that of the fiber strip, and a third-stage draft ratio in said third-stage draft zone is 10 to 150, and the obtained fiber assembly is output from the exit of the drafting mechanism and is twisted into spun yarns.

2. The method for drafting spun yarns in three stages according to claim 1, wherein the twist and weight of the obtained fiber strand, fiber band, or fiber assembly are respectively detected by a detector in the first-stage draft zone, second-stage draft zone, and third-stage draft zone of said drafting mechanism; the driving of each line of rollers is controlled by a separate servo motor; the revolutions of each line of rollers are respectively adjusted by the separate servo motor according to a detection signal received by a controller from the detector and a corresponding preset value or scope of preset value of each draft zone so that the twist and fiber weight of the obtained fiber strand, fiber band, or fiber assembly can fall within the scope required for each draft zone.

3. The method for drafting spun yarns in three stages according to claim 2, wherein the four lines of rollers of said drafting mechanism are a rear drafting roller pair, a middle-rear drafting roller pair, a middle-front drafting roller pair, and a front drafting roller pair, respectively; the first-stage, second-stage, and third-stage draft zones are respectively formed between said rear drafting roller pair and said middle-rear drafting roller pair, between said middle-rear drafting roller pair and said middle-front drafting roller pair, and between said middle-front drafting roller pair and said front drafting roller pair.

4. The method for drafting spun yarns in three stages according to claim 3, wherein the detector in the first-stage draft zone sends the detection signal containing the twist and fiber weight of the obtained fiber strand to the controller; the controller compares the detection signal with the preset value or scope of preset value of the first-stage draft zone and adjusts a number of revolutions of the rear drafting roller pair and the middle-rear drafting roller pair through the corresponding servo motors according to the comparison result so that the twist of the obtained fiber strand is 75% to 95% of that of the fiber strip and the fiber weight is 71% to 99% of that of the fiber strip.

5. The method for drafting spun yarns in three stages according to claim 3, wherein the detector in the second-stage draft zone sends the detection signal containing the twist and fiber weight of the obtained fiber band to the controller; the controller compares the detection signal with the preset value or scope of preset value of the second-stage draft zone and adjusts a number of revolutions of the middle-front drafting roller pair according to the comparison result and a number of revolutions of the middle-rear drafting roller pair so that the twist of the obtained fiber band is 15% to 60% of that of the fiber strip and the fiber weight is 47% to 98% of that of the fiber strip.

6. The method for drafting spun yarns in three stages according to claim 3, wherein the detector in the third-stage draft zone sends the detection signal containing the twist and fiber weight of the obtained fiber assembly to the controller; the controller compares the detection signal with the preset value or scope of preset value of the third-stage draft zone and adjusts a number of revolutions of the front drafting roller pair according to the comparison result and a number of revolutions of the middle-front drafting roller pair so that the obtained fiber assembly is twist less and the fiber weight is 0.3% to 9.8% of that of the fiber strip.

7. The method for drafting spun yarns in three stages according to claim 3, wherein said rear drafting roller pair consists of a rear upper roller and a rear lower roller, said middle-rear drafting roller pair consists of a middle-rear upper roller with a middle-rear upper apron and a middle-rear lower roller with a middle-rear lower apron, said middle-front drafting roller pair consists of a middle-front upper roller with a middle-front upper apron and a middle-front lower roller with a middle-front lower apron, and said front draft roller pair consists of a front upper roller and a front lower roller.

8. The method for drafting spun yarns in three stages according to claim 7 wherein said rear lower roller, middle-rear lower roller, middle-front lower roller, and front lower roller are respectively driven by corresponding servo motors to rotate; said rear upper roller, middle-rear upper roller, middle-front upper roller, and front upper roller are driven by the corresponding rollers to rotate.

9. The method for drafting spun yarns in three stages according to claim 7, wherein said middle-rear upper apron and middle-rear lower apron, and said middle-front upper apron and middle-front lower apron respectively touch each other closely and rotate reversely to frictionally untwist and draft fiber strands to obtain non-discrete fiber bands without twist redistribution.

10. The method for drafting spun yarns in three stages according to claim 7, wherein a downward-pressing bar is equipped in the third-stage draft zone of said drafting mechanism, said downward-pressing bar touches fiber assemblies, and the detector in the third-stage draft zone of said drafting mechanism is a trace detector.

11. The method for drafting spun yarns in three stages according to claim 1, wherein a maximum total draft ratio of said drafting mechanism is 320.

* * * * *